US007108360B2

(12) United States Patent
Lu et al.

(10) Patent No.: US 7,108,360 B2
(45) Date of Patent: Sep. 19, 2006

(54) STRUCTURE OF STACKED INKJET HEAD

(75) Inventors: Chun-Fu Lu, Hsinchu (TW); Fa-Yuan Hsu, Hsinchu (TW); Howard Liu, Hsinchu (TW); Cheng-Yi Wang, Hsinchu (TW); Huen-Ling Chen, Hsinchu (TW); Chi-Bin Lo, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 300 days.

(21) Appl. No.: 10/801,560
(22) Filed: Mar. 17, 2004
(65) Prior Publication Data

US 2005/0099468 A1 May 12, 2005

(30) Foreign Application Priority Data

Nov. 7, 2003 (TW) ..... 92131313 A

(51) Int. Cl.
*B41J 2/045* (2006.01)
(52) U.S. Cl. ..... 347/71
(58) Field of Classification Search ..... 347/70–71; 29/890.1
See application file for complete search history.

(56) References Cited

U.S. PATENT DOCUMENTS

| | | | | |
|---|---|---|---|---|
| 5,598,196 | A | 1/1997 | Braun | |
| 5,855,713 | A | 1/1999 | Harvey | |
| 6,037,707 | A | 3/2000 | Gailus et al. | |
| 6,134,761 | A | 10/2000 | Usui | |
| 6,309,055 | B1 * | 10/2001 | Sakai et al. | 347/70 |
| 6,758,554 | B1 * | 7/2004 | Kamei et al. | 347/70 |
| 6,925,712 | B1 * | 8/2005 | Murai | 29/890.1 |
| 6,955,420 | B1 * | 10/2005 | Ito | 347/71 |

* cited by examiner

*Primary Examiner*—K. Feggins
(74) *Attorney, Agent, or Firm*—Birch, Stewart, Kolasch and Birch, LLP

(57) ABSTRACT

A structure of the stacked inkjet head is composed of a stacked fluid structure and an actuator. At least one of the several plates in the stacked fluid structure has a junction with a tuning hole for enhancing the connection strength of the junction, accommodating overflown adhesive, and reducing structural deformation resulted from the temperature. The invention also avoids the troubles of inhomogeneous etching speeds when making nozzles or channels.

5 Claims, 5 Drawing Sheets

STRUCTURE OF STACKED INKJET HEAD

This Non-provisional application claims priority under 35 U.S.C. § 119(a) on Patent Application Ser. No(s). 092131313 filed in Taiwan on Nov. 7, 2003, the entire contents of which are hereby incorporated by reference.

BACKGROUND OF THE INVENTION

1. Field of Invention

The invention relates to a structure of inkjet head and, in particular, to a connection structure of a stacked inkjet head.

2. Related Art

The main technologies involved in inkjet print heads are piezoelectric inkjet heads and thermal bubble inkjet heads. The difference between them is whether the actuator used for pushing ink is of the thermal bubble type of the piezoelectric type. The thermal bubble actuator uses a heater to instantaneously vaporize ink, producing high-pressure bubbles to push ink out of nozzles. The piezoelectric actuator uses deformation of piezoelectric ceramics under an external voltage to push liquid out of nozzles. Relative to the thermal bubble type, the piezoelectric inkjet head does not have chemical changes resulting from high temperatures to affect the printing quality. Moreover, it does not have repeated high thermal stress. Therefore, it is more durable.

Since the deformation of piezoelectric ceramic materials is not too large, the channel has to be specially designed in order to eject droplets. The conventional method of making piezoelectric inkjet heads normally take several pieces of machined plates and stack them together to obtain a special fluid structure. The machining of the plates is normally performed by wet etching. However, when the etching pattern changes significantly as one needs to make large-area channels and small-size nozzles, the etching speed may become unstable. This is the etching error. The reason is that the reaction ions for nozzles will be taken away by nearby large-area channels, resulting in a lower etching speed than others.

During the process of assembling many plates, they have to be accurately aligned. Since the piezoelectric material is ceramics, the plate junction can be achieved by stacking and sintering several layers of green sheets. For example, the method for making multiple layered inkjet head disclosed U.S. Pat. No. 6,134,761 stacks several layers of ceramics to form a fluid structure with an actuator, ink channels, and a cavity. The structure is sintered and combined with a nozzle plate and fluid structure by co-fired process. Nevertheless, the sintered ceramic green sheets may encounter precision problems as sintering shrink. Moreover, there may have cracks or bubbles when stacking the green sheets. This will cause problems in the strength of the fluid structure.

On the other hand, one often uses epoxy or solder for the connection of some plates. For example, the piezoelectric inkjet head described in the U.S. Pat. No. 5,598,196 has the cover plate and the fluid structure connected by soldering. The soldering metal also provides electrical communications with the exterior. However, the coating precision for connections using adhesive is very stringent; otherwise, it is likely to have such problems as cracks, departure or adhesive overflow to clog the channels or nozzles. Therefore, as disclosed in the U.S. Pat. No. 6,037,707, a connection structure for the electrodes of a piezoelectric ceramic actuator and a piezoelectric ceramic layer is used to enhance the connection among the plates. A rough surface is formed on the upper surface of the piezoelectric ceramic layer to increase the junction area. An adhesive is used to connect the upper surface of the piezoelectric ceramic layer and a deformable electrode. A similar principle can be applied to the connections of nozzle plates. As shown in the U.S. Pat. No. 5,855,713, micro cavities are formed on the surface of a nozzle plate by laser ablation. Then an adhesive is used to stick the nozzle plate to the fluid structure.

SUMMARY OF THE INVENTION

In order to solve the problems caused by alignment and clogging, people often complicate the manufacturing processes. The invention provides a stacked inkjet head structure. We use a special structure design to solve the problems of adhesive clogging, weak connection strengths, and cracks. At the same time, the invention can improve the situation of inhomogeneous etching for making nozzles or channels.

The disclosed structure of a stacked inkjet head is comprised of a stacked fluid structure and an actuator. The stacked fluid structure has more than one fluid channel, ink cavity, and nozzle. The fluid channels provide the passages for a fluid to enter the ink cavities. The ink cavities eject the fluid out of the nozzles when they are under pressure. The stacked fluid structure is formed with a plurality of plates. Each plate has several through holes that are connected with one another to form the fluid channels, ink cavities, and nozzles. In the plates, the junction surface of at least one plate has more than one adjusting hole. The actuator is connected to the stacked fluid structure to put a pressure on the ink cavities. The plate with the adjusting holes has a smaller contact area. Under the same pressure, the stress on a unit area can increase. The adjusting holes also results in a larger thermal expansion room for the whole stacked fluid structure, buffering the deformation caused by temperature or pressure. The stacked fluid structure further includes the adhesive coated on the junction surface of the plate to enhance the connection strength among the plates. The adjusting holes can accommodate the overflown adhesive to avoid the clogging of the channels or nozzles. The adjusting holes can also function as the controlling mechanism of the junction to increase the connection strength.

Moreover, the adjusting holes and through holes are formed on the plate with the adjusting holes by wet etching. Generally speaking, if the area or size of the through holes on the plate varies a lot, the etching speed may be unstable. However, etching the adjusting holes at the same time can balance the overall etching speed to reach the goal of accurately control the etching precision.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

The stacked inkjet head structure of the invention makes use of a plate with adjusting holes. The adjusting hole design solves the problems of adhesive clogging, insufficient connection strength and cracks. Since the disclosed structure can be easily assembled, the manufacturing cost and difficulty are lowered.

Figure 1:
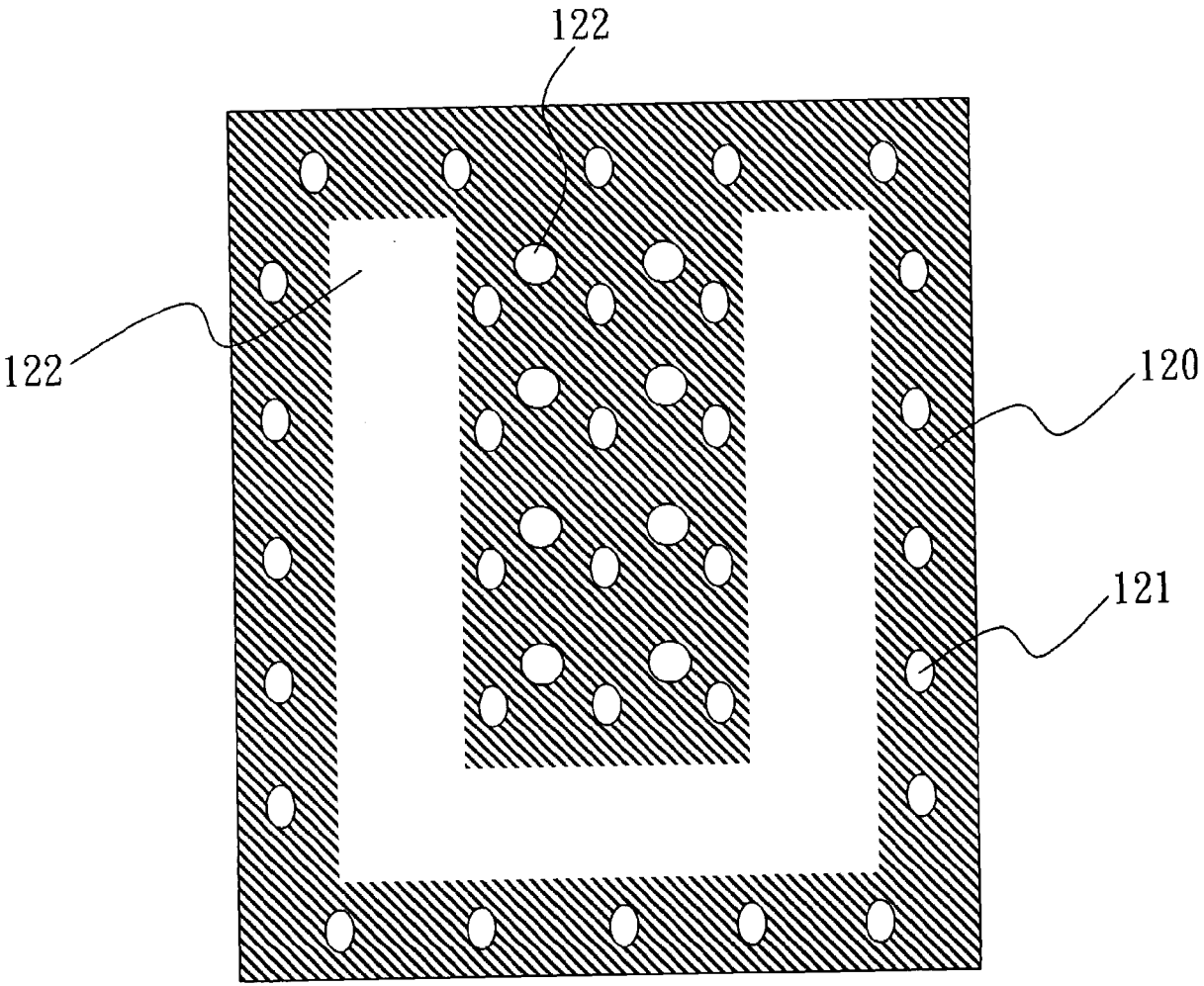
FIG. 1 is a schematic view of a plate with adjusting holes.

With reference to FIG. 1, the plate 120 has several through holes 122 and adjusting holes 121. The through holes 122 can be divided into the channel through holes with a larger size and the nozzles with a smaller size. The adjusting holes 121 are homogeneously distributed on the junction surface of the plate 120. The adjusting holes can be penetrating holes or blind holes of the plate. The adjusting hole design can avoid the concentration of reacting ions at the channel through holes with a larger size when forming the channel through holes, nozzles, and adjusting holes by wet etching. The overall etching speed and hole sizes are thus more precisely controlled.

Figure 2:
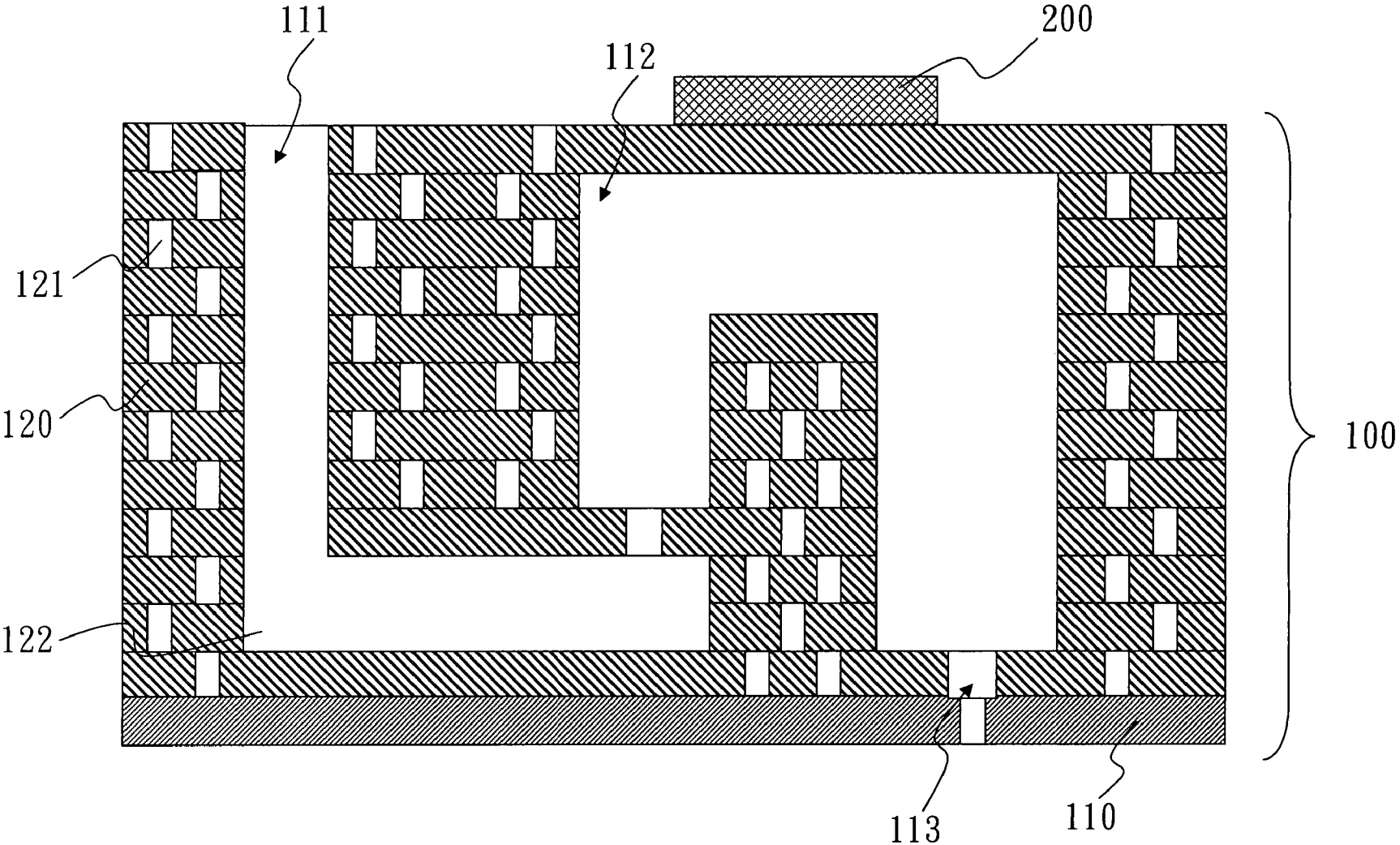
FIG. 2 is a schematic view of the disclosed structure according to the first embodiment; and FIG. 3 to FIG. 5 is a locally expanded view of the first embodiment.

Please refer to FIG. 2 for a first embodiment of the invention. The structure is comprised of a stacked fluid structure 100 and an actuator 200. The stacked fluid structure 100 is formed by stacking several plates 120, including a nozzle plate 110 and several plates 120 with adjusting holes 121 stacked on the nozzle plate 110. Each plate 120 has several through holes 122 that are connected with one another to form the fluid channels 111, the ink cavities 112, and the nozzles 113. The fluid channel 111 provides passages for a fluid to enter the ink cavities 112. The ink cavities 112 eject the fluid out of the nozzles 113 under pressure. The actuator 200 is connected to the top of the ink cavities of the stacked fluid structure 100 to impose a pressure thereon. The stacked fluid structure 100 further contains an adhesive (not shown) coated on the junction surface of the plate 120 to enhance the connection strength. The plate can be a silicon substrate or a ceramic substrate.

Figure 3:
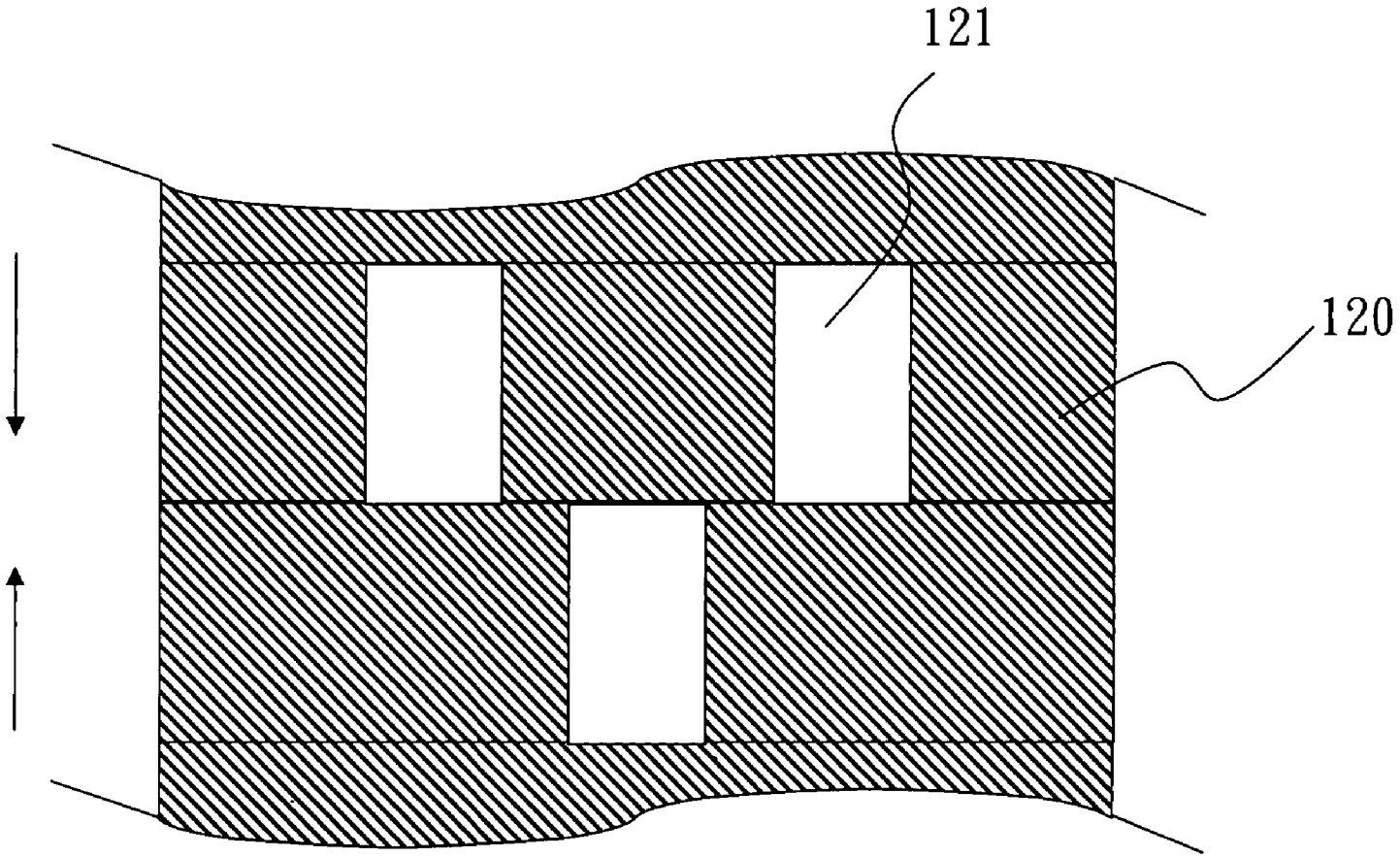
Figure 4:
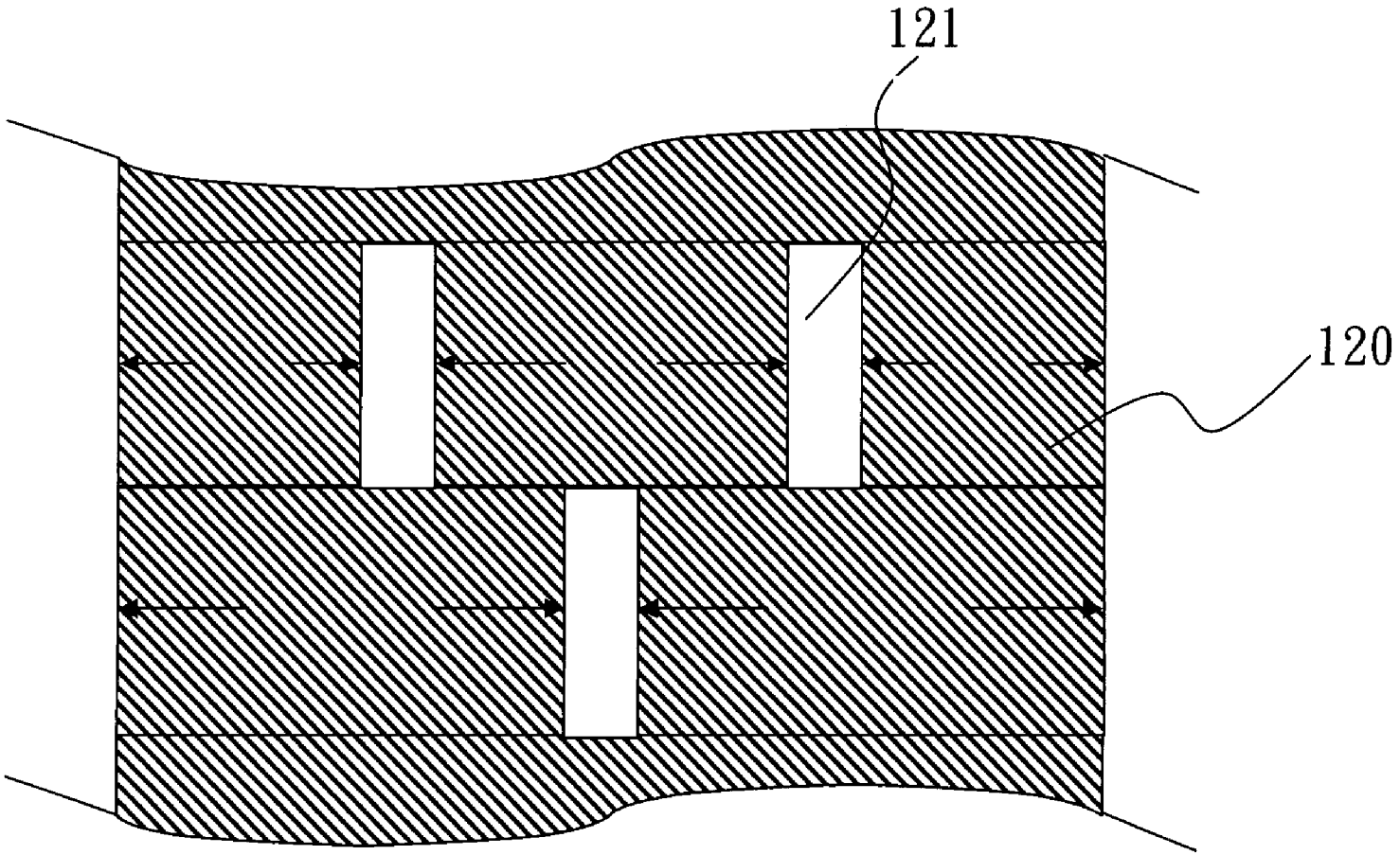
Figure 5:
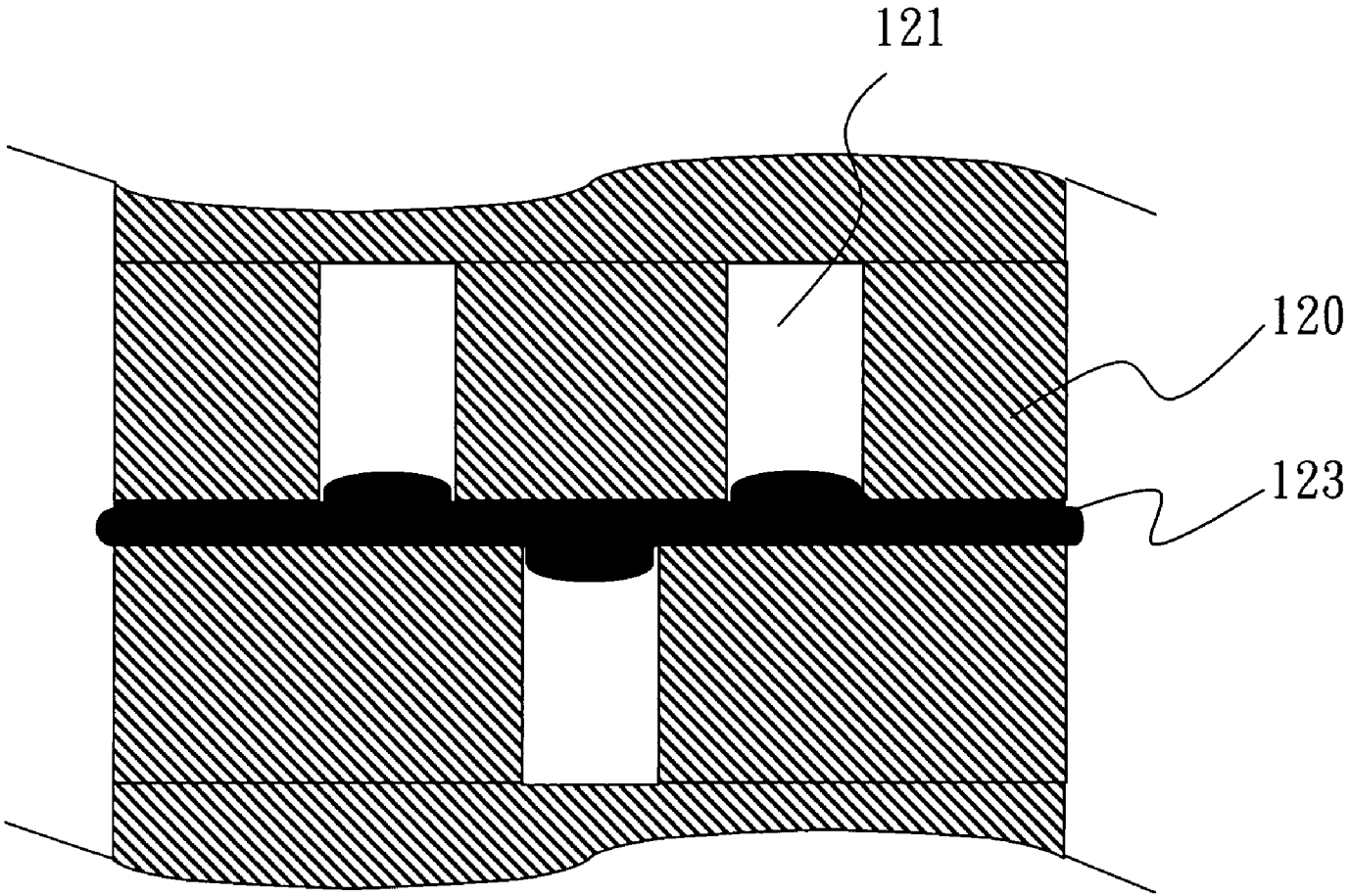

We expand a local portion of the embodiment to explain the functions of the adjusting holes. As shown in FIG. 3, the plate 120 with adjusting holes 121 has a smaller contact area. Under the same pressure, the stress on the unit area is increased. In this case, one can always obtain better connections whether the embossing, diffusion, anode welding or supersonic welding method is employed. As shown in FIG. 4, the adjusting holes 121 can increase the thermal expansion room of the whole stacked fluid structure 100, buffering the deformation cased by temperature or pressure. As shown in FIG. 5, the adjusting holes 121 can accommodate overflown adhesive 123 on the plate 120 to avoid clogging.

Moreover, the adjusting hole also functions as a controlling mechanism for the junction to enhance the connection strength. If an adjusting hole is a penetrating hole, it can be connected to other similar adjusting holes to help removing gas inside the stacked fluid structure.

Certain variations would be apparent to those skilled in the art, which variations are considered within the spirit and scope of the claimed invention.

What is claimed is:

1. A stacked inkjet head structure comprising:

a stacked fluid structure, which is formed by stacking a plurality of plates and has at least one fluid channels, ink cavities, and nozzles, each of the plates having at least one through holes connected with one another to form the fluid channels, the ink cavities, and the nozzles and at least one of the plates has a at least one adjusting holes, the fluid channels provide passages for a fluid to enter the ink cavities and the ink cavities eject the fluid out of the nozzles; and an actuator, which is connected to the stacked fluid structure to impose a pressure on the ink cavities, the adjusting holes are blind holes that do not penetrate through the plate.

2. The stacked inkjet head structure of claim 1, further containing an adhesive coated on the junction surface of the plate with adjusting holes.

3. The stacked inkjet head structure of claim 1, wherein the adjusting holes and the through holes on the plate with adjusting holes are formed by wet etching.

4. The stacked inkjet head structure of claim 1, wherein the plate is a silicon substrate.

5. The stacked inkjet head structure of claim 1, wherein the plate is a ceramic substrate.

* * * * *